US005947693A

United States Patent [19]

Yang

[11] Patent Number: 5,947,693

[45] Date of Patent: Sep. 7, 1999

[54] LINEAR COMPRESSOR CONTROL CIRCUIT TO CONTROL FREQUENCY BASED ON THE PISTON POSITION OF THE LINEAR COMPRESSOR

[75] Inventor: Soon-Bae Yang, Seoul, Rep. of Korea

[73] Assignee: LG Electronics, Inc., Rep. of Korea

[21] Appl. No.: 08/848,919

[22] Filed: May 1, 1997

[30] Foreign Application Priority Data

May 8, 1996 [KR] Rep. of Korea ..... 1996/15062

[51] Int. Cl.[6] ..... F04B 49/00

[52] U.S. Cl. ..... 417/45; 417/44.11

[58] Field of Search ..... 417/44.1, 45, 44.11; 318/254, 139

[56] References Cited

U.S. PATENT DOCUMENTS

| | | | |
|---|---|---|---|
| 4,492,526 | 1/1985 | Hartwig et al. | 417/45 |
| 5,481,166 | 1/1996 | Moreira | 318/254 |
| 5,568,023 | 10/1996 | Grayer et al. | 318/139 |
| 5,739,650 | 4/1998 | Kimura et al. | 318/254 |

*Primary Examiner*—Charles G. Freay
*Assistant Examiner*—Robert Z. Evora
*Attorney, Agent, or Firm*—Ostrolenk, Faber, Gerb & Soffen, LLP

[57] ABSTRACT

A linear compressor operating apparatus includes a rectifying and filtering unit for converting an alternating current into a direct current, an inverter for inverting the direct current outputted from the rectifying and filtering unit into a desired frequency alternating current for operating a linear compressor in accordance with the alternating current outputted from the inverter, a position sensor for detecting a position of a piston of the linear compressor and outputting a position signal in accordance with said detection, a current detector for detecting the current running through the linear compressor, and a controller for receiving a current signal outputted from the current detector and a position signal outputted from the position sensor and outputting a pulse width modulating signal to control the inverter. The apparatus obtains a constant value of an interval which determines the efficiency of the linear compressor, regardless of a load thereof and optimizes a phase angle between the driving current and the compressor piston.

2 Claims, 2 Drawing Sheets

FIG. 1
CONVENTIONAL ART
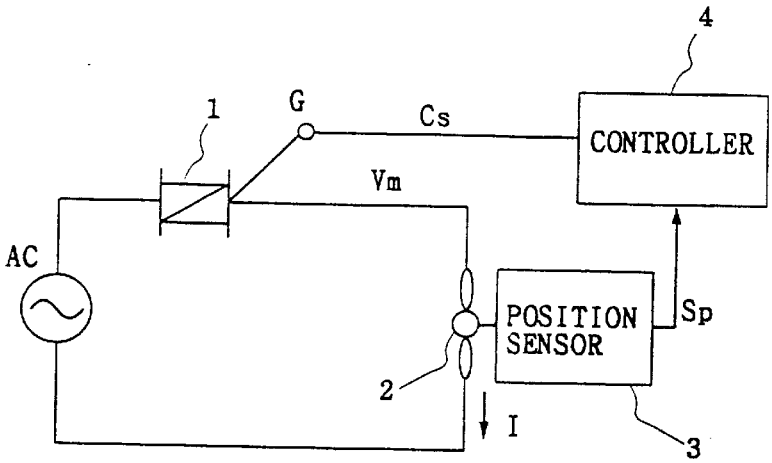
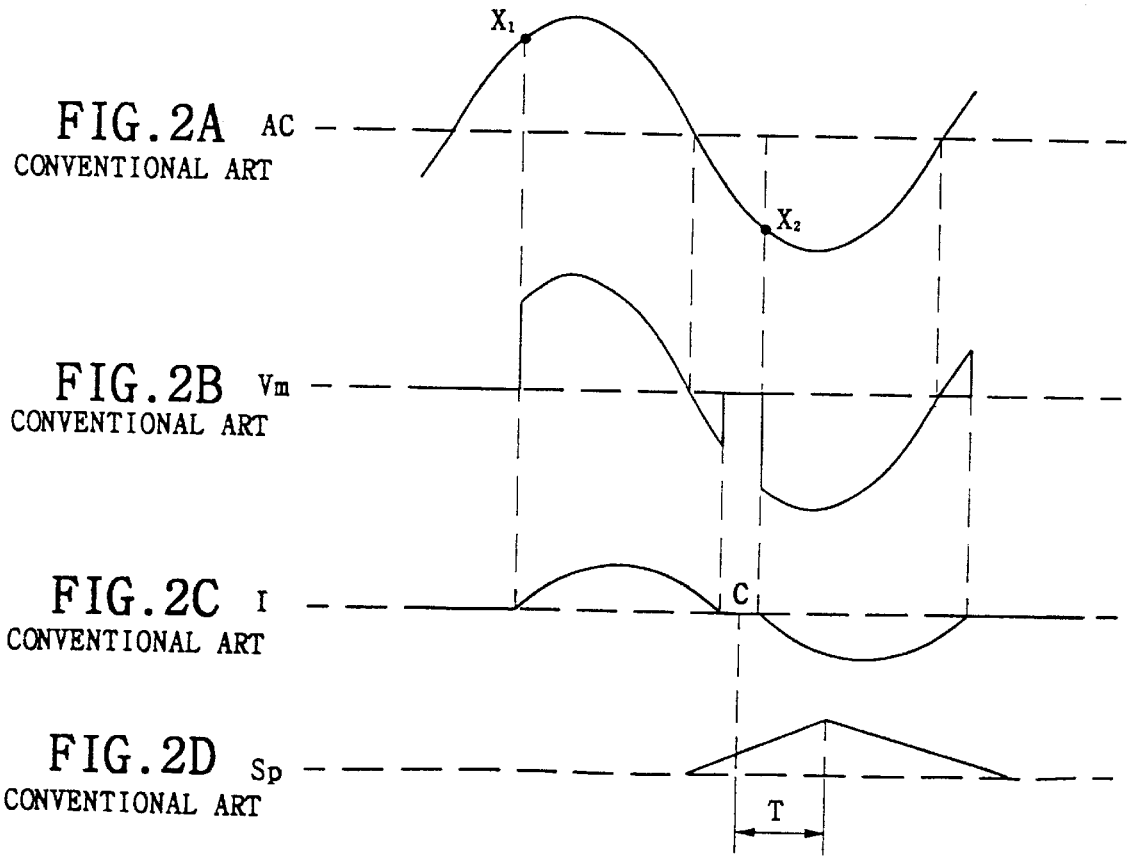

LINEAR COMPRESSOR CONTROL CIRCUIT TO CONTROL FREQUENCY BASED ON THE PISTON POSITION OF THE LINEAR COMPRESSOR

BACKGROUND OF THE INVENTION

1. Field of the Invention

The present invention relates to a linear compressor operating apparatus, and more particularly to an improved input buffer circuit which is appropriately operated in a high efficiency mode.

2. Description of the Prior Art

As shown in FIG. 1, a conventional linear compressor operating apparatus includes a triac 1 for turning on/off the supply of an alternating current AC; a linear compressor 2 for being operated in accordance with a voltage Vm supplied via the triac 1; a position sensor 3 for outputting a position signal Sp by sensing the position of a piston (not shown) of the linear compressor 2; and a controller 4 for receiving the position signal Sp outputted from the position sensor 3 and outputting a control signal Cs to a gate terminal G of the triac 1.

The operation of the conventional linear compressor operating apparatus will now be described.

First, as shown in FIG. 2A, the triac 1 is turned on at checking points $x_1$, $x_2$, respectively when the alternating current AC is applied thereto, and as shown ir FIG. 2B the voltage Vm is outputted to the linear compressor 2 which is in turn operated, and the current I running through the linear compressor 2 flows as shown in FIG. 2C.

At this time, the position sensor 3 detects the position of a piston (not shown) of the linear compressor 2 and outputs a position signal Sp as shown in FIG. 2D.

The controller 4 receives the position signal Sp outputted from the position sensor 3 and outputs the control signal Cs to the gate G of the triac 1 to thereby control the triac 1.

As shown in FIGS. 2C and D, an interval T between point C at which the current zero-crosses and a peak point of the position signal Sp serves as a crucial factor in determining the efficiency of the linear compressor 2.

However, the interval T is variable in response to a load of the linear compressor 2 and the efficiency of the linear compressor 2 tends to be lower.

SUMMARY OF THE INVENTION

Accordingly, it is an object of the present invention to provide a linear compressor operating apparatus for, regardless of a load thereof, obtaining a constant value of an operating interval which determines the efficiency thereof.

It is another object of the present invention to provide a linear compressor operating apparatus for being operated in a higher efficiency mode by optimizing a phase angle of a position signal which detects the location of a piston.

To achieve the above-described objects, the linear compressor operating apparatus according to the present invention includes a rectifying and filtering unit for converting an alternating current to a direct current, an inverter for inverting the direct current outputted from the rectifying and filtering unit to a desired frequency alternating current, for operating a linear compressor in accordance with the alternating current outputted from the inverter, a current detector for detecting the current running through the linear compressor and outputting a current detection signal, and a controller for receiving the current detection signal outputted from the current detector and the position signal outputted from the position sensor and outputting a pulse width modulating signal.

BRIEF DESCRIPTION OF THE DRAWINGS

FIG. 1 is a schematic diagram of a conventional linear compressor operating apparatus;

FIGS. 2A–2D are timing diagrams of waveforms with regard to respective units in the apparatus of FIG. 1;

DETAILED DESCRIPTION OF THE INVENTION

Figure 3:
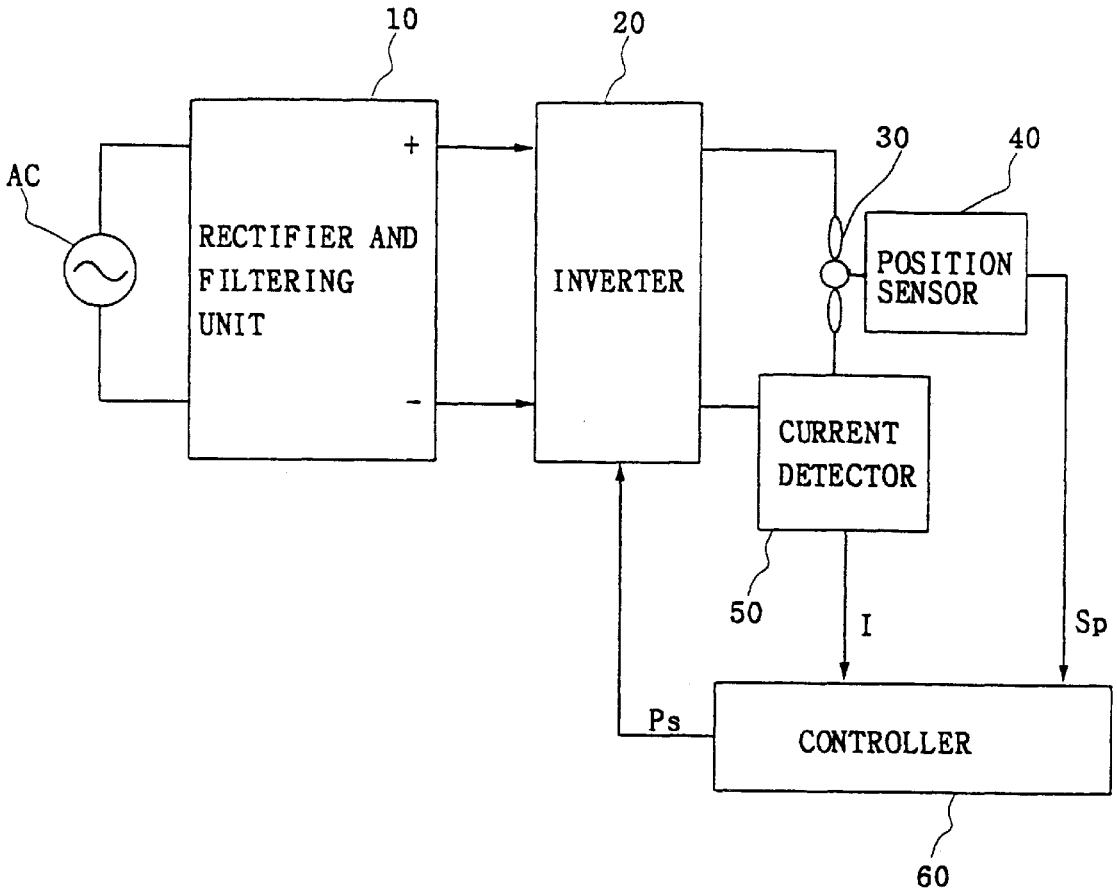
FIG. 3 is a schematic block diagram of a linear compressor operating apparatus according to the present invention.

As shown in FIG. 3, the linear compressor operating apparatus according to the present invention includes: a rectifying and filtering unit 10 for converting an alternating current AC into a direct current DC; an inverter 20 for inverting the direct current DC outputted from the rectifying and filtering unit 10 into a desired frequency alternating current AC; a linear compressor 30 for being operated in accordance with the alternating current outputted from the inverter 20; a position sensor 40 for detecting the position of a piston of the linear compressor and outputting a position signal Sp; a current detector 50 for detecting the current running through the linear compressor 30 and outputting a current signal I; and a controller 60 for receiving the current signal I outputted from the current detector 50 and the position signal Sp outputted from the position sensor 40 and outputting a pulse width modulating signal Ps for controlling the inverter.

Figure 4:
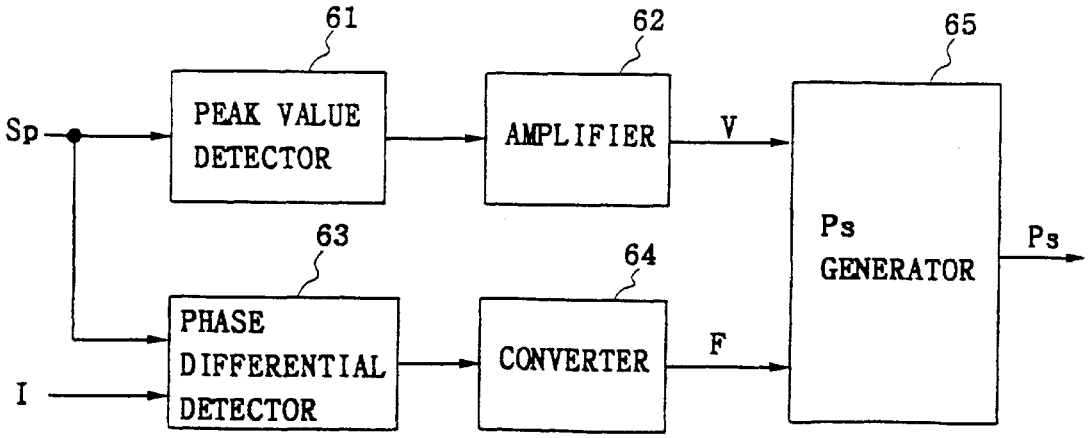
FIG. 4 is a detailed block diagram of a controller in the apparatus of FIG. 3.

Referring to FIG. 4, the controller 60 includes a peak value detector 61 for detecting a peak value of the position signal Sp outputted from the position sensor 40; an amplifier 62 for amplifying the peak value of the position signal Sp to a certain level; a phase differential detector 63 for detecting a phase differential between the position signal Sp outputted from the position sensor 40 and the current signal I outputted from the current detector 50; a converter 64 for converting the phase differential outputted from the phase detector 63 to a frequency f; and a pulse width signal generator 65 for receiving the voltage V outputted from the amplifier 62 and the frequency f outputted from the converter 64 and outputting the pulse width modulating signal Ps to the inverter 20.

With reference to the accompanying drawings, the operation of the linear compressor operating apparatus according to the present invention will now be described.

The rectifying and filtering unit 10 rectifies and filters the alternating current AC into a direct current voltage and outputs the resultant DC voltage to the inverter 30.

The direct current DC voltage outputted from the rectifying and filtering unit 10 is converted through the inverter 20 into an alternating current and applied to the linear compressor 30.

When the alternating current outputted from the inverter 20 is applied to the linear compressor 30 and it begins operating, the position sensor 40 detects the position of a piston (not shown) of the linear compressor 30 and outputs the detected position signal Sp to the controller 60.

At this time, the current detector 50 detects the current running through the linear compressor 30 by means of a current transformer (not shown) and outputs the detected current signal I to the controller 60.

Next, the controller 60 receives the position signal Sp outputted from the position sensor 40 and the current signal I outputted from the current detector 50 and outputs the pulse width modulating signal Ps to the inverter 30.

Therefore, the inverter 30 converts the direct current DC outputted from the rectifying and filtering unit 10 into a desired frequency alternating current AC in accordance with the pulse width modulating signal Ps outputted from the controller 40, for thereby operating the linear compressor 50.

The operation of the controller 60 will be further described with reference to FIG. 4.

First, the position signal Sp outputted from the position sensor 40 is applied to the peak value detector 61 and accordingly the peak value thereof is detected.

The peak value detected from the peak value detector 61 is amplified to a certain level voltage in the amplifier 62 and the amplified voltage V is outputted to the pulse width modulating signal generator 65.

Here, the position of the piston (not shown) of the linear compressor 30 is proportional to the voltage V so that the position of the piston of the linear compressor 30 serves as a voltage value and accordingly the voltage VT is outputted.

At this time, the phase differential detector 63 compares respective phases of the position signal Sp outputted from the position sensor 40 and the current signal I outputted from the current detector 50, and the compared phase differential is outputted to the converter 64.

The converter 64 converts the phase differential outputted from the phase differential detector 63 into a voltage value. A present voltage value is compensated to the extent of the converted voltage value to thereby generate a new voltage value, which is converted into an alternating current voltage of frequency f and outputted to the pulse width modulating signal generator 65.

Consequently, the pulse width modulating signal generator 65 receives the voltage V proportional to the position signal Sp outputted from the amplifier 62, and the frequency signal f outputted from the converter 64 compensated in accordance with the phase differential of the current signal I and the position signal Sp and then outputs the pulse width modulating signal Ps to the inverter 20.

As described above, the linear compressor operating apparatus according to the present invention controls and constantly maintains the interval T as shown in FIG. 2D in accordance with the controller 60, whereby the linear compressor 30 can be operated in a higher efficiency mode.

Further, the phase angle between the current running through the linear compressor 30 and position signal Sp which represents the position of the piston (not shown) of the linear compressor 30 is controlled to obtain an optimal phase angle therebetween so that the linear compressor 30 is operated in a higher efficiency mode.

What is claimed is:

1. An apparatus for operating a linear compressor including a reciprocating piston, the apparatus comprising:

a rectifying and filtering unit for converting an alternating current into a direct current;

an inverter for inverting the direct current outputted from the rectifying and filtering unit into an alternating current of a desired frequency for operating the linear compressor;

a position sensor for detecting a position of the piston of the linear compressor and outputting a position signal in accordance with said detection;

a current detector for detecting a current running through the linear compressor and outputting a current signal in accordance with said detection; and a controller for receiving the current signal outputted from the current detector and the position signal outputted from the position sensor and outputting a pulse width modulating signal to control the inverter.

2. The apparatus of claim 1, wherein the controller, comprises:

a peak value detector for detecting a peak value of the position signal outputted from the position sensor;

an amplifier for amplifying the detected peak value of the position signal to a selected, predetermined voltage level;

a phase differential detector for detecting a phase differential between the position signal outputted from the position sensor and the current signal outputted from the current detector;

a converter for converting the phase differential detected by the phase differential detector into a frequency signal; and a pulse width signal generator for receiving a voltage outputted from the amplifier and the frequency signal outputted from the converter and outputting the pulse width modulating signal to the inverter.

* * * * *